US007730576B1

(12) United States Patent
Snyder

(10) Patent No.: US 7,730,576 B1
(45) Date of Patent: Jun. 8, 2010

(54) COMPUTER MOUSE CLEANING APPARATUS

(76) Inventor: Daniel E. Snyder, 2104 Wildflower Dr., Fullerton, CA (US) 92833

( * ) Notice: Subject to any disclaimer, the term of this patent is extended or adjusted under 35 U.S.C. 154(b) by 0 days.

(21) Appl. No.: 12/113,679

(22) Filed: May 1, 2008

(51) Int. Cl.
*A47L 5/00* (2006.01)

(52) U.S. Cl. ..... 15/344; 15/383

(58) Field of Classification Search ..... 15/344, 15/383; *A47L 5/10*
See application file for complete search history.

(56) References Cited

U.S. PATENT DOCUMENTS 5,418,999 A 5/1995 Smith
5,519,910 A 5/1996 Messina
5,970,559 A 10/1999 Christy
D424,044 S 5/2000 Wong et al.
6,264,756 B1 7/2001 Boys
6,298,514 B1 10/2001 Lazich et al.
6,467,119 B1 10/2002 Van Meter et al.
6,666,926 B2 * 12/2003 Naghi et al. ..... 134/8
2002/0171630 A1 11/2002 Peacemaker

* cited by examiner

*Primary Examiner*—David A Redding

(57) ABSTRACT

The present invention is directed to a computer mouse cleaning apparatus for providing a cleaning mechanism including a cylindrical tube, a compressible rubber boot, a brush, and power source to allow a person to clean the inner portion of a computer mouse.

1 Claim, 3 Drawing Sheets

COMPUTER MOUSE CLEANING APPARATUS

FIELD OF THE INVENTION

The present invention is directed to a computer mouse cleaning apparatus for providing a cleaning mechanism including a cylindrical tube, a compressible rubber boot, a brush, and power source to allow a person to clean the inner portion of a computer mouse.

BACKGROUND OF THE INVENTION

An object of this invention is to provide a computer mouse cleaning apparatus that is easy to use, small in size, and effective, without being costly. Another object of this invention is to create a compact device that creates a vacuum effect to remove any dirt or particles found in the inner portion of a computer mouse.

SUMMARY OF THE INVENTION

The present invention provides a mouse cleaning device, comprising a hollow tubular base member, a push button, a vent, and a removeable base member, said push button disposed on an outer surface of said hollow tubular base member, said push button extending through said outer surface to an inner portion of said hollow tubular base member, said push button connecting to an electrical connection, said push button when pressed in an inward direction causing said electrical connection to turn on and activate a motor, said motor housed within said hollow tubular base member, said motor powered by a set of batteries, said set of batteries removeably housed within said hollow tubular base member, said motor when activated causes a fan fixedly attached to a shaft to turn in a first direction, said first direction causing a vacuum effect within said hollow tubular base member; and a compressible member fixedly attached to an outer rim of said hollow tubular base member, said compressible member is pushed in a downward direction to expose a brush, said brush fixedly attached to a top end of said shaft, said brush is rotated by said motor and rotates in a first direction and when inserted into a bottom aperture of a computer mouse, removes particles from said computer mouse, said particles are extracted from said computer mouse, said vacuum effect causing loose particles to be pulled from within said computer mouse, said particles are pushed out of said hollow tubular base member through a vent said vent is fixedly attached to said outer surface of said hollow tubular base member, said removeable base member is removeably attached to a bottom end of said base members said removeable base member is removed to insert said set of batteries, said removeable base member is reinserted into said bottom end of said base member when said set of batteries have been installed.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
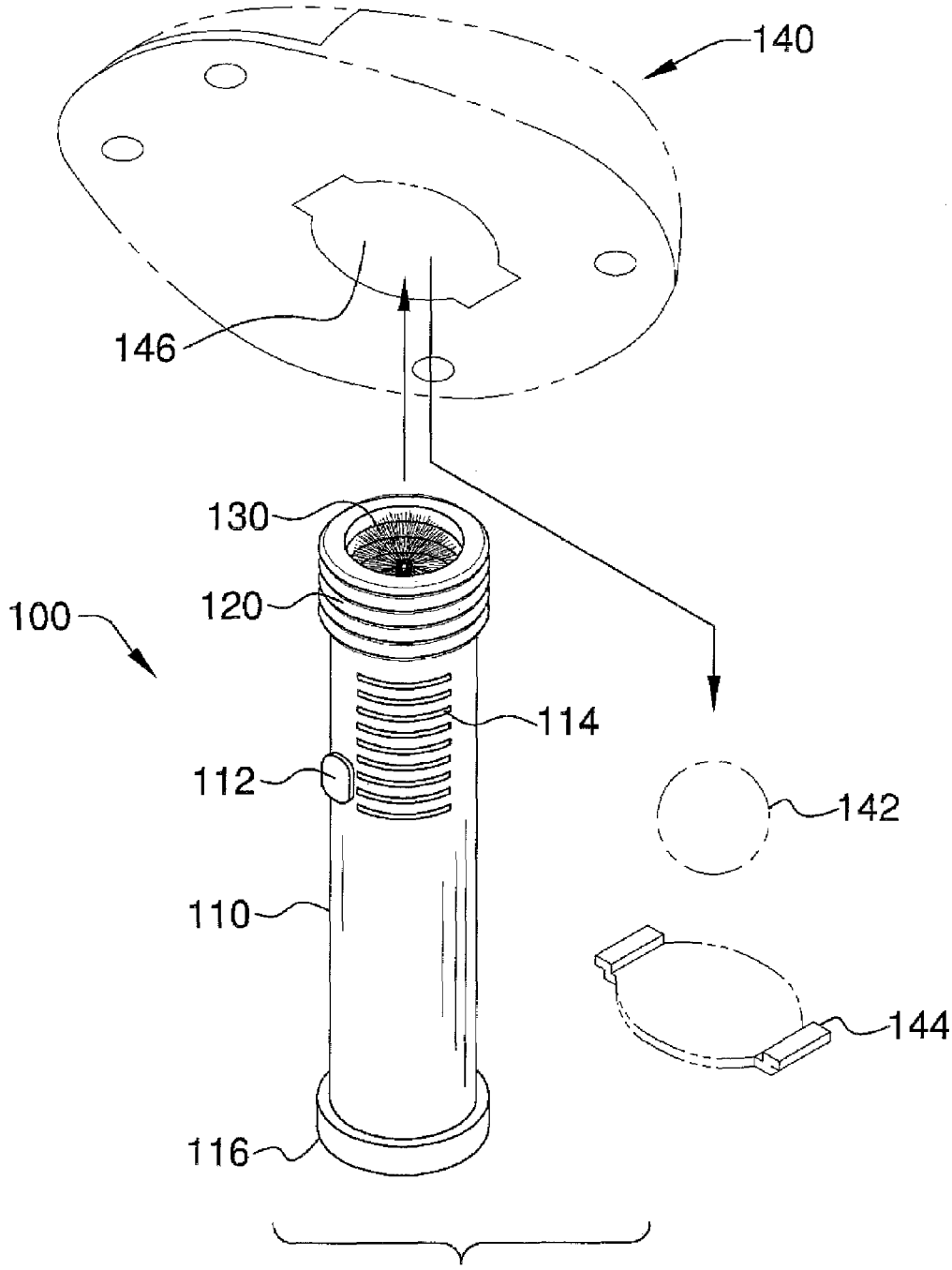
FIG. 1 is an illustration of a mouse cleaning device according to the invention including a base member, a compressible member, a vacuum member, and a brush.

Referring now to FIG. 1, mouse cleaning device 100 comprises base member 110, compressible member 120, and brush 130. In the illustrated embodiment of FIG. 1, base member 110 comprises push button 112, vent 114, and removeable base 116. In the illustrated embodiment of FIG. 1, a person can remove covering 144 and ball 142 and from the bottom of computer mouse 140. The person can then insert base member 110 into opening 146. As a person pressed base member 110 upward into opening 146, compressible member 120 will compress downward until brush 130 is exposed (see FIG. 4). A person can then activate a motor housed within base member 110 to start a fan that causes a vacuum effect to extract particles and dirt from within computer mouse 140. In the illustrated embodiment of FIG. 1, any particles or dirt extracted from mouse 140 are dispersed into the air through vent 114. In the illustrated embodiment of FIG. 1, removeable base 116 can be removed from base member 110 to allow a person to insert new batteries into the bottom of base member 110 (see FIG. 3).

In certain embodiments, base member 110 comprises a rigid material selected from the group consisting of metal, plastic, and combinations thereof. In certain embodiments, base member 110 comprises a cylindrical tube having an outside diameter between about 1⅛ inches and about 1½ inches, for example 1¼ inches. In certain embodiments, base member 110 comprises a length between about 4½ inches and about 5½ inches, for example 5 inches. In certain embodiments, compressible member comprises a standard flexible, compressible rubber boot known to one skilled in the art. In certain embodiments, brush 130 comprises a nylon brush known to one skilled in the art. In other embodiments, brush 130 comprises a boar's hair brush known to one skilled in the art. In certain embodiments, push button comprises a standard on/off switch to activate a power source.

Figure 2:
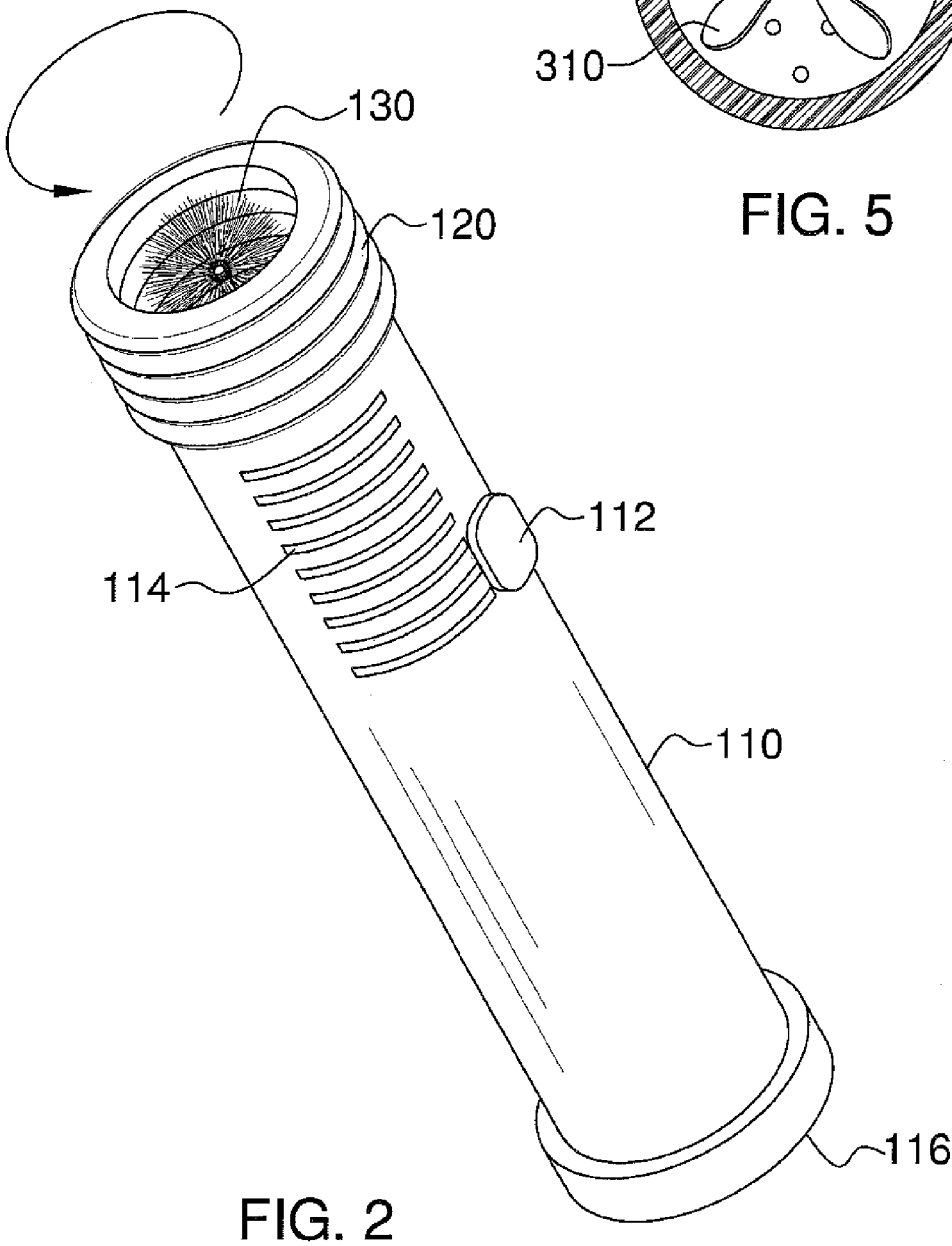
FIG. 2 is an illustration of the mouse cleaning device according to FIG. 1, showing the motion of the brush.

Referring now to FIG. 2, mouse cleaning device 100 comprises base member 110, compressible member 120, and brush 130. In the illustrated embodiment of FIG. 2, base member 110 comprises push button 112, vent 114, and removeable base 116. In the illustrated embodiment of FIG. 2, the movement of brush 130 is shown moving in a counterclockwise direction. In certain embodiments, brush 130 moves in a clockwise direction.

Figure 3:
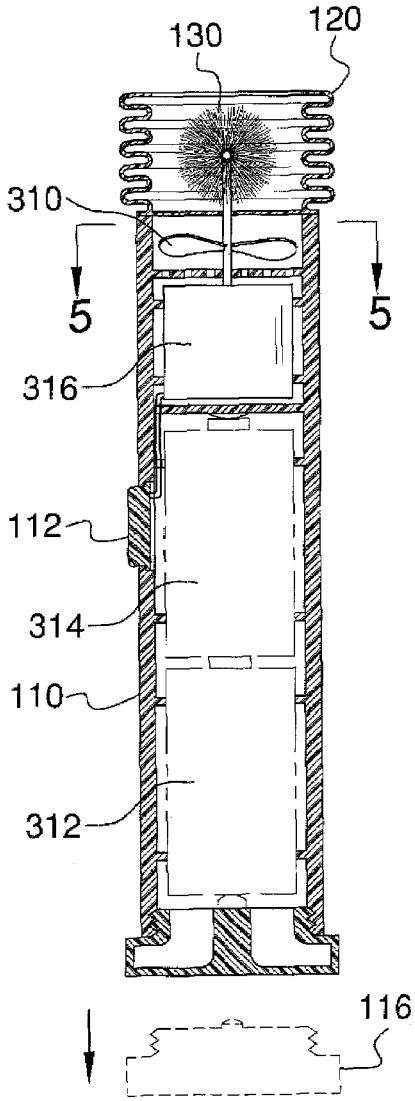
FIG. 3 is a cross section view of the front of the mouse cleaning device of FIG. 1.

Referring now to FIG. 3, a side cross section view of mouse cleaning device 100 is shown comprising base member 110, compressible member 120, brush 130, fan 310, first battery 312, second battery 314, and motor 316. In the illustrated embodiment of FIG. 3, base member 110 comprises push button 112, and removeable base 116. A person can press push button 112 to activate power from first battery 312 and second battery 314 to cause motor 316 to turn on. When motor 316 is turned on, the power will cause fan 310 to rotate. As a person inserts mouse cleaning device 100 into computer mouse 140, compressible member 120 is compressed to exposed brush 130. In the illustrated embodiment of FIG. 3, fan 310 causes a vacuum effect and extracts any particles or dirt from within computer mouse 140 as brush 130 loosens the particles and dirt.

In certain embodiments, first battery 312 and second battery 314 comprise standard "D" batteries known to one skilled in the art. In certain embodiments, first battery 312 and second battery 314 comprise standard C batteries known to one skilled in the art. In certain embodiments, motor 316 comprises a standard 3-volt motor known to one skilled in the art. In certain embodiments, fan 310 comprises a standard four-blade fan known to one skilled in the art. In other embodiments, fan 310 comprises at least one fan blade. In other embodiments, fan 310 comprises more than one fan blade.

Figure 4:
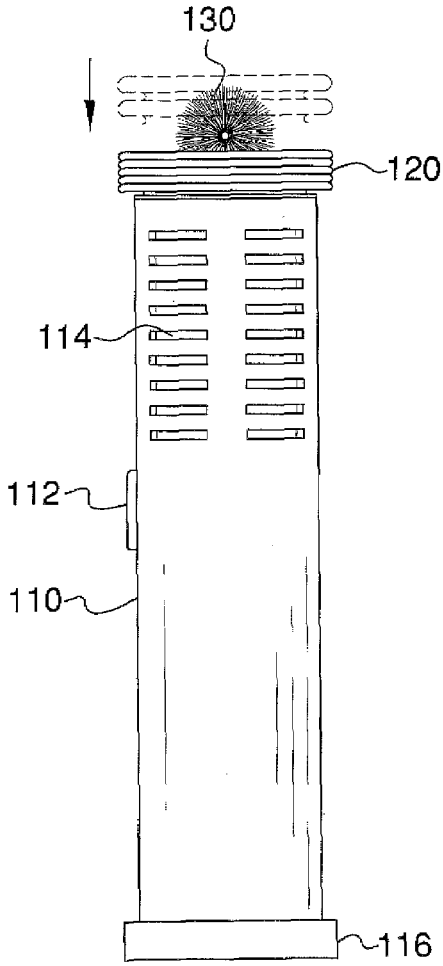
FIG. 4 is a side view of the mouse cleaning device of FIG. 1, showing the compression of the compressible member.

Referring now to FIG. 4, a side view of mouse cleaning device 100 is shown comprising base member 110, compressible member 120, and brush 130. In the illustrated embodiment of FIG. 4, base member 110 comprises push button 112, vent 114, and removeable base 116. In the illustrated embodiment of FIG. 4, compressible member 120 is compressed in a downward motion to allow brush 130 to be exposed to loosen particles and dirt attached to the inside of opening 146 of computer mouse 140.

Figure 5:
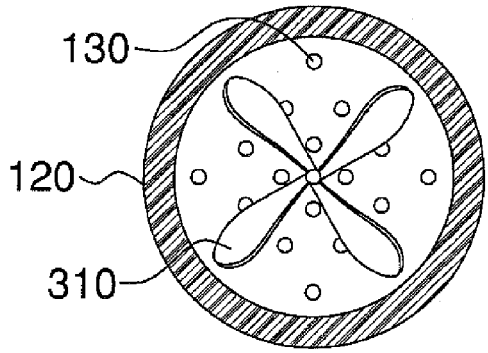
FIG. 5 is a top view of the mouse cleaning device of FIG. 1.

Referring now to FIG. 5, a top view of mouse cleaning device 100 is shown comprising compressible member 120, brush 130, and fan 310. In the illustrated embodiment of FIG. 5, fan 310 turns within base member 110 and provides a vacuum effect to extract particles and dirt that are loosened within mouse 140 by brush 130.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment, of the present invention, it will be readily apparent to those skilled in the art that modifications may be made thereto which do not exceed the scope of the appended claims. Therefore, the scope of the invention is only to be limited by the following claims.

What is claimed is:

1. A mouse cleaning device, comprising:

a hollow tubular base member, a push button, a vent, and a removeable base member, said push button disposed on an outer surface of said hollow tubular base member, said push button extending through said outer surface to an inner portion of said hollow tubular base member, said push button connecting to an electrical connection, said push button when pressed in an inward direction causing said electrical connection to turn on and activate a motor, said motor housed within said hollow tubular base member, said motor powered by a set of batteries, said set of batteries removeably housed within said hollow tubular base member, said motor when activated causes a fan fixedly attached to a shaft to turn in a first direction, said first direction causing a vacuum effect within said hollow tubular base member, and a compressible member fixedly attached to an outer rim of said hollow tubular base member, said compressible member is pushed in a downward direction to expose a brush constructed to fit within the aperture, said brush fixedly attached to a top end of said shaft, said brush is rotated by said motor and rotates in a first direction and when inserted into a bottom aperture of a computer mouse, removes particles from said computer mouse, said particles are extracted from said computer mouse, said vacuum effect causing loose particles to be pulled from within said computer mouse, said particles are pushed out of said hollow tubular base member through said vent, said vent is fixedly attached to said outer surface of said hollow tubular base member, said removeable base member is removeably attached to a bottom end of said base member, said removeable base member is removed to insert said set of batteries, said removeable base member is reinserted into said bottom end of said base member when said set of batteries have been installed.

* * * * *